US011707143B2

(12) United States Patent
Porterfield et al.

(10) Patent No.: US 11,707,143 B2
(45) Date of Patent: Jul. 25, 2023

(54) DISPLAY SYSTEM

(71) Applicant: BOX BROKERS, INC., Brea, CA (US)

(72) Inventors: James E. Porterfield, Aliso Viejo, CA (US); Larry Johnson, Colleyville, TX (US)

(73) Assignee: BOX BROKERS, INC., Brea, CA (US)

( * ) Notice: Subject to any disclaimer, the term of this patent is extended or adjusted under 35 U.S.C. 154(b) by 134 days.

(21) Appl. No.: 17/380,778

(22) Filed: Jul. 20, 2021

(65) Prior Publication Data

US 2023/0025070 A1 Jan. 26, 2023

(51) Int. Cl.

| | |
|---|---|
| ***A47F 3/06*** | (2006.01) |
| ***A47F 7/03*** | (2006.01) |
| ***A47F 3/00*** | (2006.01) |

(52) U.S. Cl.

CPC ..... *A47F 3/063* (2013.01); *A47F 3/001* (2013.01); *A47F 7/03* (2013.01)

(58) Field of Classification Search

CPC ..... A47F 5/0081; A47F 3/063; A47F 3/001; A47F 7/03; A47B 88/40; A47B 96/025; A45C 11/16; A45C 5/065

USPC ..... 211/126.15, 150; 190/16; 312/208.1, 312/334.27, 334.8

See application file for complete search history.

(56) References Cited

U.S. PATENT DOCUMENTS 939,721 A * 11/1909 Lewis ..... A47F 7/03 229/120.32
2,047,097 A * 7/1936 Dunbar ..... A47F 3/06 211/169.1
2,295,697 A * 9/1942 Sulentic ..... A47B 88/49 312/334.8
2,314,943 A * 3/1943 Jensen ..... A47F 7/03 206/557
2,351,378 A * 6/1944 Weissman ..... A47F 7/03 206/45.29
2,811,404 A * 10/1957 Brooks ..... A47F 3/063 312/270.3
3,003,839 A * 10/1961 Bloom ..... A47B 87/0284 312/111
3,406,821 A * 10/1968 Weissberg ..... A45C 11/16 220/315

(Continued)

*Primary Examiner* — Jennifer E. Novosad
(74) *Attorney, Agent, or Firm* — Innovation Capital Law Group, LLP; Vic Lin

(57) ABSTRACT

A display includes a riser and a cap where articles, such as jewelry elements and their holders, can be placed. The riser has a riser base and a riser side and the cap includes a cap side and a cap platform, wherein the cap side is in at least one of sliding and removable engagement with the riser side. In an alternative embodiment, the riser has a riser guide coupled with the riser side or the riser base, and the display further includes a drawer. The drawer has a drawer top, a drawer side, a drawer side guide coupled with the drawer side, and a drawer top guide. The cap has a cap platform and, at least one of a groove in the cap platform and a cap platform wide coupled with the cap platform. The groove and/or the cap platform guide is in at least one of sliding and removable engagement with the drawer top guide. In yet another embodiment, the display further includes removable light fixtures having light emitting diodes.

19 Claims, 9 Drawing Sheets

(56) References Cited

U.S. PATENT DOCUMENTS 3,554,625 A * 1/1971 Sly, Sr. ..... A47F 7/03 312/126
3,806,220 A * 4/1974 Payne ..... A47B 27/00 211/126.15
4,958,889 A * 9/1990 Boyle ..... G06F 1/1632 248/455
5,104,080 A * 4/1992 Berger ..... A47J 37/0786 211/90.01
5,213,401 A * 5/1993 Hatcher ..... A47B 21/0314 361/679.08
5,344,033 A * 9/1994 Herman ..... A47B 57/04 108/6
6,036,288 A * 3/2000 Shih ..... A47B 21/0314 312/334.8
6,206,495 B1 * 3/2001 Peterson ..... A47B 21/0314 312/283
6,364,136 B1 * 4/2002 Weshler ..... A47F 5/103 211/175
6,394,567 B1 * 5/2002 Welch ..... A47B 88/43 312/334.41
6,612,665 B2 * 9/2003 Nielsen ..... A47B 46/00 312/208.1
6,681,953 B2 * 1/2004 Au ..... A45C 11/10 220/815
7,063,219 B2 * 6/2006 Fann ..... A47B 96/025 211/74
7,828,253 B2 * 11/2010 Meyer ..... A47B 21/00 108/50.01
9,924,605 B2 * 3/2018 Leyden ..... G07G 1/0018
10,477,991 B1 * 11/2019 Fragala ..... A47F 7/02
2009/0008349 A1 * 1/2009 Kim ..... F16M 11/10 211/150
2014/0354001 A1 * 12/2014 Hanley ..... B60P 3/007 296/24.44
2023/0025070 A1 * 1/2023 Porterfield ..... A47F 3/001

* cited by examiner

DISPLAY SYSTEM

COPYRIGHT

A portion of the disclosure of this patent document contains material which is subject to copyright protection. The owner has no objection to the facsimile reproduction by anyone of the patent disclosure, as it appears in the Patent and Trademark Office files or records, but otherwise reserves all copyright rights whatsoever.

FIELD OF INVENTION

The present invention relates to a display and method of displaying an article via the display. The display includes a riser and a cap where, for instance, jewelry elements and their holders can be placed. In an alternative embodiment, the display further includes a drawer. In a further embodiment, the display further includes removable light fixtures having light emitting diodes. The display further provides a storage space for storing articles related to the display. Although the display of the present invention is described as a jewelry display, the system can readily be used to display any other article.

BACKGROUND

Conventional jewelry displays are bulky and take up valuable space in the vault. The displays come in different sizes and configurations. There are single piece displays and trays to hold a dozen or more pieces. There are larger pieces to hold a necklace, and ramps to hold 20-30 chains. Every morning, a jeweler with a safe/vault retrieves the jewelry from the safe/vault and individually places them into a conventional jewelry box or onto a conventional display. Then every evening the jeweler must collect the jewelry from the boxes, or display elements, and return the jewelry to the safe/vault. Jewelers with larger vaults collect the display elements or boxes every evening, place them in plastic tubs, then place the plastic tubs into the vault, this way avoiding the need to take the jewelry off each individual display or out of each box. In the morning, the jeweler then retrieves the plastic tubs and individually places the displays elements or boxes back into the showcase. This process is time consuming. Therefore, there is a need for a jewelry display that provides a platform that can hold jewelry and can be readily removed along with the jewelry to be placed in the vault.

The display elements used with the present invention all have magnets in their bases. They adhere to the cap platforms, which decreases the chance of display elements falling off the cap platforms when being put in or retrieved from the safe/vault. The cap platforms, being a thin sheet of wood (½" or thinner), take up minimal safe/vault space, allow a jeweler to transport $\frac{1}{3}^{rd}$ of a showcase at a time safely with the magnetized displays adhered to the platform caps.

Two main issues which concern a typical jeweler are addressed. The present invention makes it much easier and quicker to open and close the store. All jewelry needs to be carried to and from their safe or vault each morning and each evening. The display of the present invention has risers with removable caps that have all the elements magnified to them, make this task much easier and quicker. They open a showcase, remove 3 top caps, and they're done. Working with conventional displays, a jeweler would have to open their showcase, then take each element out of the case, put it in a plastic tub, stacking them on top of each other often leading to damage, then carry the plastic tub to the vault or safe. Then in the morning, the jeweler would have to take the plastic tub out of the safe, back to the case, and reset each piece up one by one by one. With the present invention, they only carry the caps back from the vault and their displays are set up the exact way they were the day before.

The other issue of concern is privacy and back strain. Having to reach far into the conventional display system in order to retract a piece of jewelry can expose the private parts of a female sales clerk to the public. Furthermore, such motions are also associated with excessive bending which cause back pain, especially for the older individuals. Moreover, these individuals perform these motions a number of times everyday which makes the task unbearable. The display of the present invention, as will be described fully below, include caps that slide in and out of their associated risers or drawers.

Historically, low-end jewelers put their jewelry into hinged jewelry boxes, and put those inside the showcase. However, most medium-to-high-end jewelers use jewelry holders (that are separate and different than the jewelry box). A jewelry holder may be a ring tray that holds 1-24 rings, a neck form that holds 1 necklace, a chain ramp that holds 20-25 necklaces, and an earring stand for 1 pair or 12 pairs of earrings. These holders are magnetized at the bottom so as to stick to the sheet metal in cap platform.

The display of the present invention, as described herein, will be placed inside a showcase to make it easy to reach goods in the front (by the sliding drawer and/or the cap, and to make it easy for jewelers, coin dealers, or any other business that has valuable goods in their showcase set up and close down each night.

The present invention comprises a riser and a cap. The riser comprises a planar base and a side along a portion of the perimeter of the base. The cap includes a platform and a side along a portion of the perimeter of the platform. This configuration allows the cap to be easily placed on the riser, slid in and out of the riser, and removed from the riser. In one configuration, the cap is made from a composite material, for instance, a layer of wood and a layer of metal on top of the wood layer. As such, jewelry holders with magnets can be magnetically coupled with the cap.

In an alternative embodiment of the present invention, the display further includes a drawer. In this configuration, the riser includes guides which are coupled with either the side or the base of the riser. The drawer has a planar top and a side along a portion of the perimeter of the top. The drawer further includes guides that are coupled with the side and engage the riser guides to readily slide in and out of the riser. The drawer top further includes one or more strips that are used to securely position the cap onto the drawer top.

SUMMARY

In one aspect, a display is disclosed, wherein the display comprises a riser comprising a riser base having a substantially planar surface, a riser side extending upwardly from at least a portion of a perimeter of the riser base, and a riser guide coupled with at least one of the riser base and the riser side, a drawer comprising a drawer top having a substantially planar surface, a drawer side extending downwardly from at least a portion of a perimeter of the drawer top, a drawer side guide coupled with the drawer side, wherein the drawer side guide is in sliding engagement with the riser guide, and a drawer top guide coupled with the drawer top, and a cap comprising a cap platform having a substantially planar surface, and at least one of a groove in the cap platform and a cap platform guide coupled with the cap platform, wherein the at least one of a groove in the cap platform and a cap platform guide coupled with the cap platform is in at least one of sliding and removable engagement with the drawer top guide.

Preferably, the riser base is rectangular.

Preferably, the riser side comprises three beams having rectangular cross sections.

Preferably, the riser guide comprises two guide rails coupled with two of the three beams along an axial direction of the riser base.

Preferably, the riser guide comprises two guide rails coupled with the riser base along an axial direction of the riser base.

Preferably, a height of the three beams is greater than zero, thereby, the display providing a storage space between the drawer and the riser.

Preferably, the drawer top is rectangular.

Preferably, the drawer side comprises two beams having rectangular cross sections.

Preferably, the drawer side guide comprises two guide rails coupled with the two beams along an axial direction of the drawer top.

Preferably, the drawer top guide comprises two strips coupled with the drawer top along an axial direction of the drawer top.

Preferably, the drawer further comprises a support beam coupled with the drawer top along a transverse direction of the drawer top.

Preferably, the drawer further comprises a handle coupled with the drawer top.

Preferably, the cap platform is rectangular.

Preferably, the cap platform comprises two grooves along an axial direction of the cap platform.

Preferably, the cap further comprises one or more magnet coupled with the cap platform along a transverse direction of the cap platform.

Preferably, the riser base, the riser side, the drawer top, the drawer side, and the cap platform are made from wood.

Preferably, the drawer top comprises a composite material made from wood and metal.

Preferably, the cap platform comprises a composite material made from wood and metal.

Preferably, the display further comprises a lighting system coupled with the riser.

Preferably, the lighting system comprises two modular light fixtures, and wherein each of the two modular light fixtures comprises a plurality of light emitting diodes.

In another aspect, a display is disclosed, wherein the display comprises a riser comprising a riser base having a substantially planar surface, and a riser side extending upwardly from at least a portion of a perimeter of the riser base, and a cap comprising a cap platform having a substantially planar surface and a cap side extending downwardly from at least a portion of a perimeter of the cap platform, wherein the cap side is in at least one of sliding and removable engagement with the riser side.

Preferably, the riser base is rectangular.

Preferably, the riser side comprises three beams having rectangular cross sections.

Preferably, the cap platform is rectangular.

Preferably, the cap side comprises three L-shaped beams, and wherein two of the three L-shaped beams are coupled with the cap platform along an axial direction of the cap platform and the third L-shaped beam is coupled with the cap platform along a transverse direction of the cap platform.

Preferably, the cap further comprises a support beam coupled with the cap platform along a transverse direction of the cap platform.

Preferably, the riser base, the riser side, and the cap platform are made from wood.

Preferably, the cap platform comprises a composite material made from wood and metal.

In another aspect, a method of displaying an article via a display is disclosed, wherein the display comprises a riser comprising a riser base having a substantially planar surface, a riser side extending upwardly from at least a portion of a perimeter of the riser base, and a riser guide coupled with at least one of the riser base and the riser side, a drawer comprising a drawer top having a substantially planar surface, a drawer side extending downwardly from at least a portion of a perimeter of the drawer top, a drawer side guide coupled with the drawer side, wherein the drawer side guide is in sliding engagement with the riser guide, and a drawer top guide coupled with the drawer top, and a cap comprising a cap platform having a substantially planar surface and at least one of a groove in the cap platform and a cap platform guide coupled with the cap platform, wherein the at least one of a groove in the cap platform and a cap platform guide coupled with the cap platform is in at least one of sliding and removable engagement with the drawer top guide, the method comprising at least one of placing the cap on the drawer, and sliding the drawer, and removing the cap from the drawer.

In another aspect, a method of displaying an article via a display is disclosed, wherein the display comprises a riser comprising a riser base having a substantially planar surface and a riser side extending upwardly from at least a portion of a perimeter of the riser base, and a cap comprising a cap platform having a substantially planar surface and a cap side extending downwardly from at least a portion of a perimeter of the cap platform, wherein the cap side is in at least one of sliding and removable engagement with the riser side, the method comprising at least one of placing the cap on the riser, sliding the cap, and removing the cap from the riser.

DETAILED DESCRIPTION OF THE PRESENTLY PREFERRED EMBODIMENTS

Figure 1:
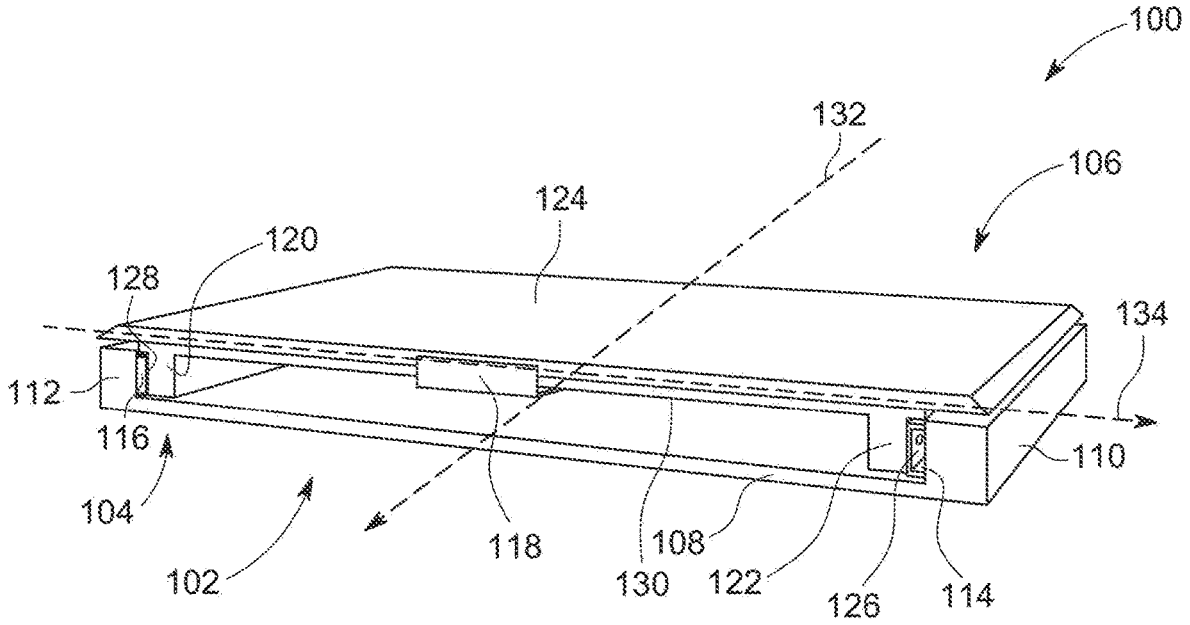
FIG. 1 shows a perspective view of a display according to a preferred embodiment. The display includes a riser having a rectangular riser base, a riser side that comprises of three beams around a perimeter of the riser base, and two riser guides that are coupled with the riser side along an axial direction of the riser base. The display further comprises a drawer that has a rectangular top and a side that comprises of two beams around a perimeter of the drawer top, and two drawer side guides that are coupled with the drawer side along an axial direction of the drawer top. The display, further includes a cap that has a cap platform, one or more grooves in the cap platform, and/or cap platform guide that is coupled with the cap platform.

FIG. 1 depicts a perspective view of a display 100 according to a preferred embodiment. The display 100 includes a riser 102 having a rectangular riser base 108, a riser side that comprises of three beams, only two of which 110 and 112 are visible, around a perimeter of the riser base 108. The riser 102 further includes two riser guides 114 and 116 which are coupled with the riser side, i.e., beam 110 and beam 112, along an axial direction 132 of the riser base 108. The display 100 further comprises a drawer 104 that has a rectangular top 130 and a side that comprises of two beams 120 and 122 around a perimeter of the drawer top 130, and two drawer side guides 126 and 128 that are coupled with the drawer side, i.e., beam 120 and 122, along an axial direction of the drawer top 130, which in this embodiment is the same direction as the axial direction 132 of the riser base 108.

The drawer side guides 126 and 128 are in sliding engagement with the two riser guides 114 and 116. Specifically, the drawer 104 can slide in both directions along the axial direction of drawer top 130. In one preferred embodiment, the drawer side guides 126 and/or 128 may comprise stops to prevent the drawer 104 from being slid completely out of the riser 102.

The drawer 104 further includes a drawer top guide (not visible in this figure, but see FIG. 3) which is coupled with the drawer top 130. The drawer 104 further includes a support beam (not visible in this figure, but see FIG. 4A) coupled with the drawer top 130 along a transverse direction 134 of the drawer top 130. The support beam operates to provide resistance to any undesired bending of the drawer top 130.

The display 100, further includes a cap 106 that has a cap platform 124 and two grooves (not visible in this figure, but see FIG. 3) in the cap platform 124. In an alternative embodiment, the cap 106 comprises a cap platform guide that is coupled with the cap platform 124. The grooves and/or the cap platform guide is in sliding and/or removable engagement with the drawer top guide. Specifically, the cap 106 can slide in both direction along an axial direction of the cap platform 124, which in this embodiment is the same direction as the axial direction 132 of the riser base 108. The cap 106 can also be freely removed from the drawer 104, i.e., lifted from or placed on the drawer top 130. The drawer 104 further includes a handle 118 for use in sliding the drawer 104 and the cap 106 in the axial direction 132. The display 100 has generally a rectangular shape in this preferred embodiment. Specifically, the riser base 108, the drawer top 130, and the cap platform 124 are substantially planar and rectangular. However, other geometric shapes, such as a combination of rectangles, squares, circles, ellipses, etc., are contemplated.

The riser 102 has a side which extends upwardly from at least a portion of the perimeter of the riser base 108. The riser side is made up of three separate beams, only two of which 110 and 112 are visible. All three beams have a rectangular cross section, although other cross sections such as square, circular, triangular, elliptical, etc., are contemplated. In another embodiment, the riser side is a single piece structure and is coupled with the riser base 108 along three sides of the riser base 108. The fourth side of the riser base 108 is not coupled with any structure and is left open. The height of the three beams is greater than zero, thereby, providing the display 100 a storage space between the riser 102 and the drawer 104 to store articles related to the display.

In this preferred embodiment, the riser side is coupled with the riser base 108 via one or more fasteners, such as bolts, screws, and/or nails. In another embodiment, the riser side may be coupled with the riser base 108 via an adhesive.

The riser base 108 and its side can be made from a single material or a composite material. In this preferred embodiment, the riser base 108 and its side, i.e., the three separate beams, only two of which 110 and 112 are visible, are made from wood.

The riser guides 114 and 116 are coupled with the riser side, i.e., beam 110 and beam 112, along the axial direction 132 of the riser base 108. In a preferred embodiment, the riser guides 114 and 116 are guide rails made from aluminum or steel. In another embodiment, the riser guides 114 and 116 are coupled with the riser base 108 (see FIG. 2). Furthermore, in this preferred embodiment, the lengths of the three beams of the riser side cover the entire three sides of the rectangular riser base 108. In another embodiment, each of the three beams cover only a portion of the perimeter of the riser base 108, i.e., each of the three beams cover only a partial length of the corresponding side of the riser base 108.

The drawer 104 has a side which extends downwardly from at least a portion of the perimeter of the drawer top 130. The drawer side is made up of two separate beams 120 and 122 which have a rectangular cross section, although other cross sections such as square, circular, triangular, elliptical, etc., are contemplated. The third and fourth side of the drawer top 130 are not coupled with any structure and are left open.

In this preferred embodiment, the drawer side is coupled with the drawer top 130 via one or more fasteners, such as bolts, screws, and/or nails. In another embodiment, the drawer side may be coupled with the drawer top 130 via an adhesive. The drawer top 130 and its side can be made from a single material or a composite material. In this preferred embodiment, the drawer top 130 is made from a composite material, namely a thick layer of wood on the bottom and a thin layer of sheet metal on the top. The sheet metal layer of the drawer top 130 will be used to magnetically secure the cap 106, via two magnets in the cap platform 124 (see FIG. 5A), to the drawer top 130.

The drawer side guides 126 and 128 are coupled with the drawer side, i.e., beam 120 and 122, along an axial direction of the drawer top 130, which in this embodiment is the same direction as the axial direction 132 of the riser base 108. In a preferred embodiment, the drawer side guides 126 and 128 are guide rails made from aluminum or steel. The drawer side guides 126 and 128 are in sliding engagement with the riser guides 114 and 116.

In this embodiment, the drawer side guides 126 and 128 are coupled to the sides of the two beams 120 and 122. In an alternative embodiment, drawer side guides 126 and 128 are coupled with the bottoms of the two beams 120 and 122 (see FIG. 4A) which engage the two riser guides 114 and 116 that are coupled with the riser base 108 (see FIG. 2).

The drawer 104 further includes a drawer top guide (not visible in this figure, but see FIG. 3) which is coupled with the drawer top 130. In this embodiment, the drawer top guide comprises two strips coupled with the drawer top 130 along the axial direction of the drawer top 130. The two strips may be made from, wood, plastic or metallic material. The drawer 104 may alternatively include a support beam, discussed below, to resist any undesirable bending of the drawer top 130.

Moreover, the lengths of the two beams of the drawer side cover the entire two sides of the rectangular drawer top 130. In another embodiment, each of the two beams cover only a portion of the perimeter of the drawer top 130, i.e., each of the two beams cover only a partial length of the corresponding side of the drawer top 130.

The cap 106 comprises the cap platform 124 and two grooves (not visible in this figure, but see FIG. 3) that are cut into the cap platform 124. In an alternative embodiment, the cap 106 incorporates a cap platform guide that is coupled with the cap platform 124. The grooves and/or the cap platform guide is in sliding and/or removable engagement with the drawer top guide. In a preferred embodiment, the drawer top guide, namely the two strips, and the grooves are generally rectangular and their corresponding dimensions are such that the grooves make either a clearance fit or an interference fit with the drawer top guide.

The cap platform 124 can be made from a single material or a composite material. In this preferred embodiment, cap platform 124 is made from a composite material, namely a thick layer of wood on the bottom and a thin layer of sheet metal on the top. The sheet metal layer of the cap platform 124 will be used to magnetically secure items, such as jewelry holders that include magnets.

Figure 2:
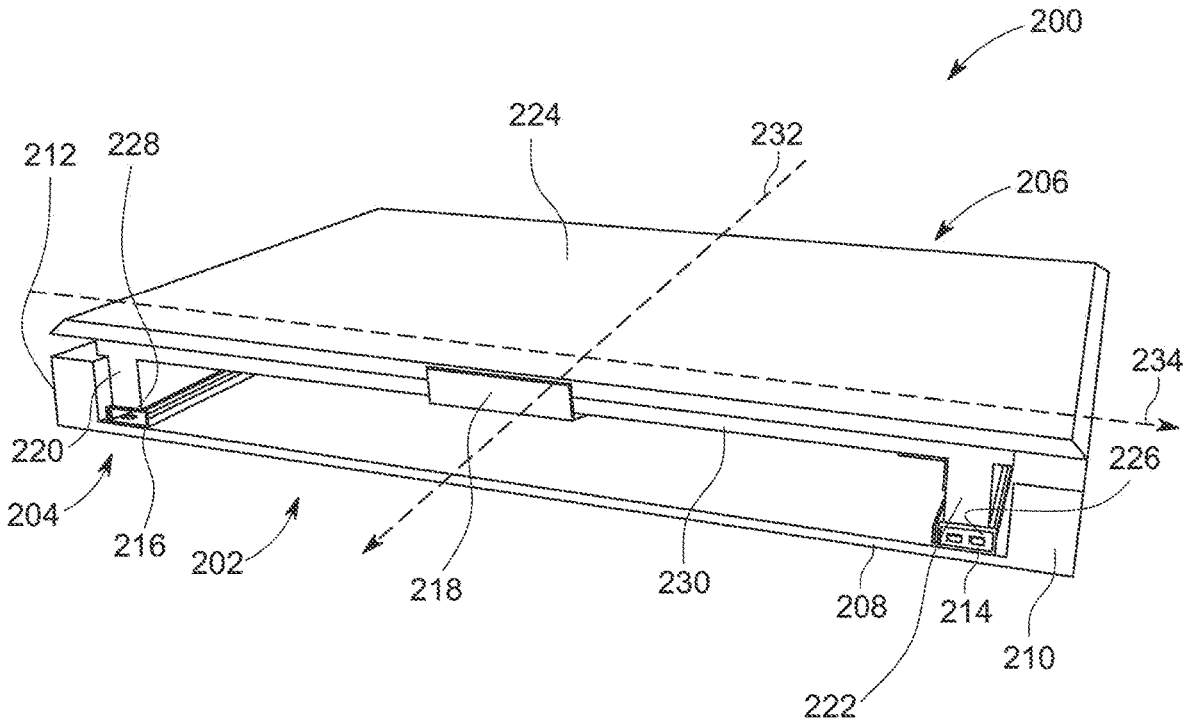
FIG. 2 shows a perspective view of a display according to a preferred embodiment. In this embodiment, the riser guide includes two guide rails which are coupled with the riser base.

FIG. 2 depicts a perspective view of a display 200 according to a preferred embodiment. The only difference between the display 200 and the display 100 is that the riser guide is coupled with the riser base and the drawer side guide is coupled with the bottom side of the drawer side. Specifically, the display 200 includes a riser 202, a drawer 204, and a cap 206. The riser 200 comprises a rectangular riser base 208, a riser side that comprises of three beams disposed around a perimeter of the riser base 208. Only two of the three beams, namely beam 210 and beam 212 are visible. The riser 202 further includes two riser guides 214 and 216 which are coupled with the riser base 208 along an axial direction 232 of the riser base 208.

The drawer 204 has a rectangular top 230 and a side that comprises of two beams 220 and 222 around a perimeter of the drawer top 230, and two drawer side guides 226 and 228 that are coupled with the drawer side, i.e., beam 220 and 222, along an axial direction of the drawer top 230, which in this embodiment is the same direction as the axial direction 232 of the riser base 208. The drawer side guides 226 and 228 are coupled with the bottom side of the beams 220 and 222. The drawer side guides 226 and 228 are in sliding engagement with the riser guides 214 and 216. The drawer 204 further includes a drawer top guide (not visible in this figure, but see FIG. 3) which is coupled with the drawer top 230. The drawer 204 further includes a support beam (not visible in this figure, but see FIG. 4A) coupled with the drawer top 230 along a transverse direction 234 of the drawer top 230. The support beam operates to provide resistance to any undesired bending of the drawer top 230.

The cap 206 has a cap platform 224 and two grooves (not visible in this figure, but see FIG. 3) in the cap platform 224. In an alternative embodiment, the cap 206 comprises a cap platform guide that is coupled with the cap platform 224. The grooves and/or the cap platform guide is in sliding and/or removable engagement with the drawer top guide. The drawer 204 further includes a handle 218 for use in sliding the drawer 204 and the cap 206 in the axial direction 232.

Figure 3:
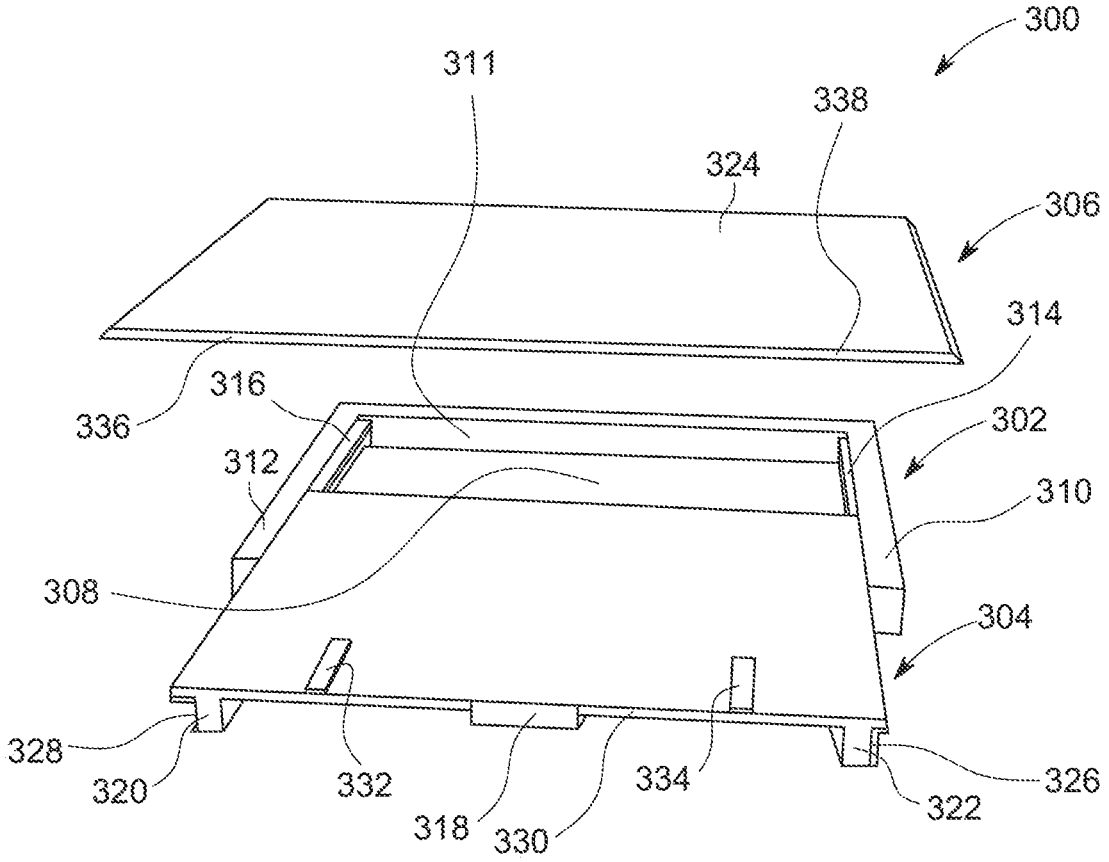
FIG. 3 shows an exploded view of the display of FIG. 1. The drawer has a drawer top guide, coupled with the drawer top, which comprises of two strips along an axial direction of the drawer top. The drawer side guide is in sliding engagement with the riser guide. The cap includes two grooves in the cap platform which are in sliding and/or removable engagement with the drawer top guide.

FIG. 3 shows an exploded view of a display 300, similar to the display 100 of FIG. 1. The display 300 comprises a riser 302, a drawer 304, and a cap 306. The riser 302 comprises a riser base 308 that is rectangular and has a substantially planar surface. The riser 302 comprises a riser side, extending upwardly from riser base 308, which comprises three beams of rectangular cross section 310, 311, and 312. The riser 302 comprises a riser guide which comprises a guide rail 314, coupled with the beam 310, and a guide rail 316, coupled with the beam 312.

The drawer 304 comprises a drawer top 330 which is rectangular and has a substantially planar surface. The drawer 304 further comprises a drawer side which extends downwardly from the drawer top 308. The drawer side comprises two beams 320 and 322 of rectangular cross section. The drawer 304 further comprises a drawer side guide which comprises a guide rail 326, coupled to the side of the beam 322, and a guide rail 328, coupled to with the side of the beam 320. The drawer guide rails 326 and 328 are in sliding engagement with the riser guide rails 314 and 316, respectively. The drawer 304 further comprises a drawer top guide which comprises two wood strips 332 and 334 which are coupled with drawer top 330.

The cap 306 comprises a rectangular cap platform 324 which has a substantially planar surface. The cap 306 further comprises two grooves 336 and 338 (see also FIG. 5A) which are cut into the cap platform 324 and are in sliding and/or removable engagement with the drawer top guide, i.e., the strips 332 and 334.

Figure 4A:
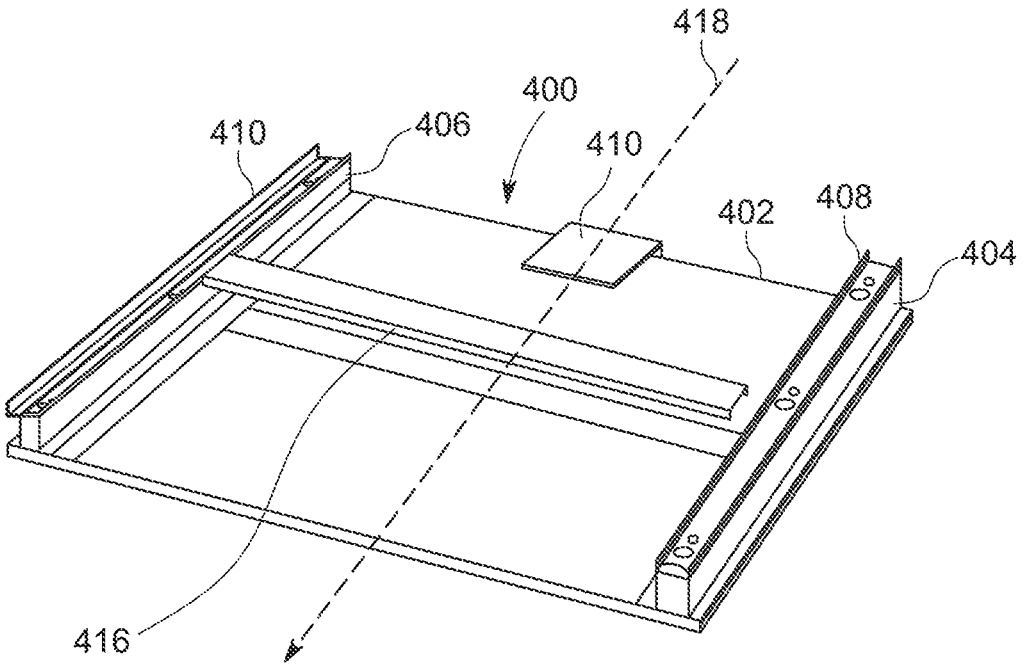
FIG. 4A shows a bottom perspective view of a drawer according to a preferred embodiment. According to this embodiment, the drawer side guides are coupled with the bottom of two beams which engage a riser guide which includes two guide rails that are coupled with the riser base, such the display shown in FIG. 2. The drawer further includes a support beam along a transverse direction of the drawer top. The support beam resists bending of the drawer top around its axial direction.

FIG. 4A depicts a bottom perspective view of a drawer 400, similar to the drawer 204, of FIG. 2. The drawer 400 has a rectangular drawer top 402 having a substantially planar surface. The drawer 400 further comprises a drawer side which includes a beam 404 and a beam 406 of rectangular cross sections. The drawer 400 further includes a drawer side guide which comprises a guide rail 408, coupled with the bottom side of the beam 404, and a guide rail 410, coupled with the bottom side of the beam 406. The drawer 400 further includes a support beam 416 which resists any undesirable bending of the drawer top 402. The drawer 400 further includes a handle 410.

Figure 4B:
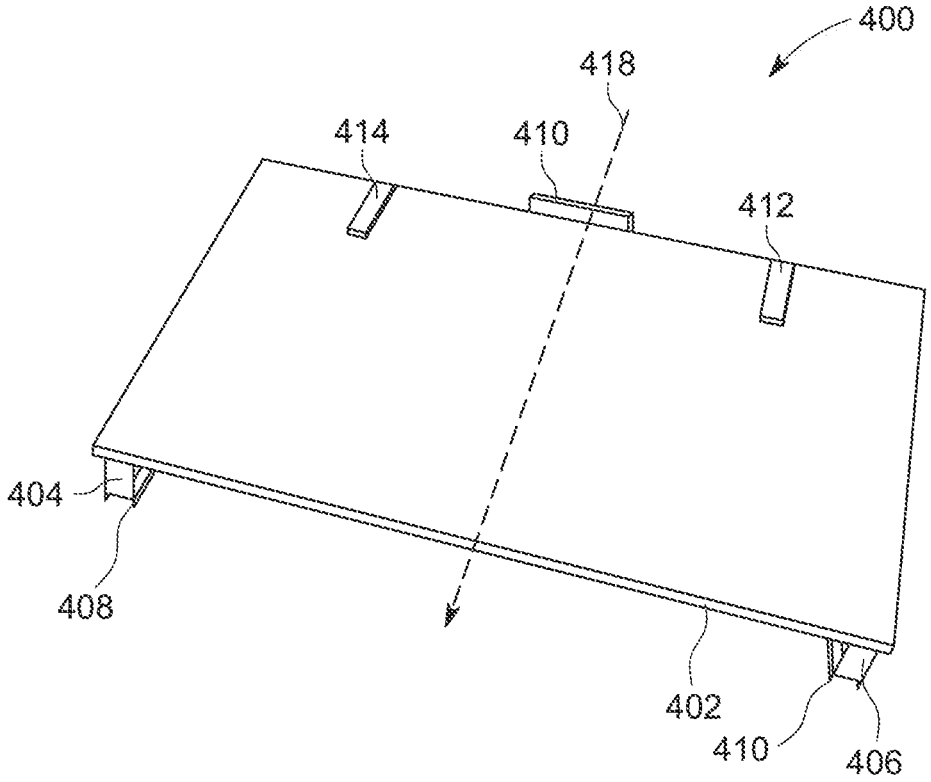
FIG. 4B shows a top perspective view of the drawer of FIG. 4A. The drawer top includes a drawer top guide which comprises of two strips that are positioned symmetrically on each side of the axial axis of the drawer top and coupled with the drawer top. A cap, such as the one shown in FIG. 3, has two grooves in the cap platform which are in sliding and/or removable engagement with the drawer top guide. The drawer top is made from a composite material consisting of a thick layer of wood and a thin layer of metal which is glued to the top of the wood.

FIG. 4B shows a top perspective view of the drawer 400 of FIG. 4A. The drawer top 402 includes a drawer top guide which, in this embodiment, comprises two strips 412 and 414 that are positioned symmetrically on each side of an axial axis 418 of the drawer top 402 and coupled with the drawer top 402. A cap, such as the cap 306 shown in FIG. 3, has two grooves 336 and 338 in the cap platform 324 which are in sliding and/or removable engagement with the drawer top guide 412 and 414, via a clearance fit or an interference fit. The drawer top 402 is made from a composite material consisting of a thick layer of wood and a thin layer of sheet metal which is glued to the top of the wood. A cap, such as the cap 306 of FIG. 3, may comprise one or more magnets embedded within the cap platform 324 (see, FIG. 5A, magnets 508 and 510) to magnetically couple the cap 306 to the drawer 400.

Figure 5A:
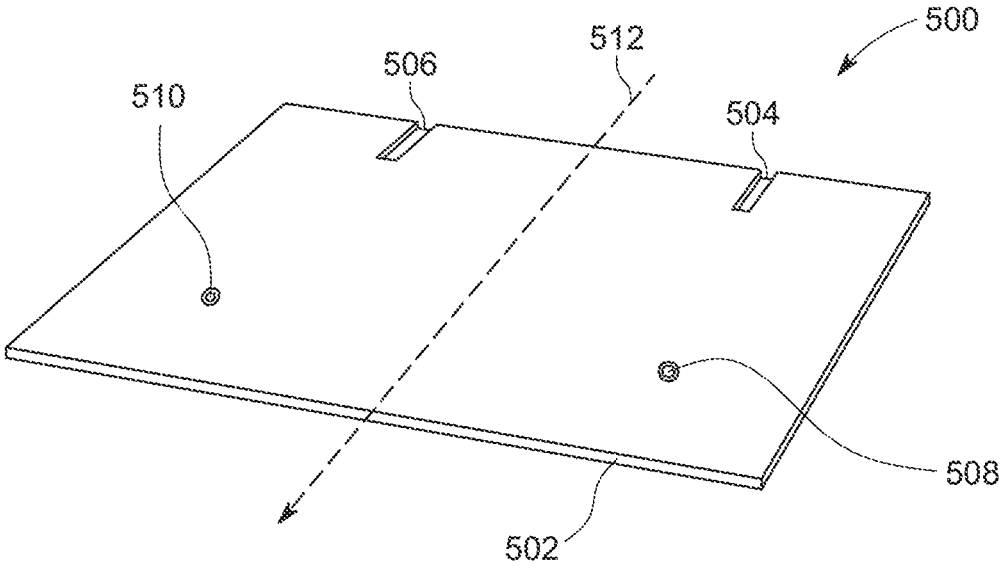
FIG. 5A shows a bottom perspective view of a cap according to a preferred embodiment. According to this embodiment, the cap has two grooves that are positioned symmetrically on each side of the axial axis of the cap platform and are cut in the bottom side of the cap platform. The grooves are in sliding and/or removable engagement with a drawer top guide, such as the one shown in FIG. 3. The cap further includes two magnets that are coupled with the cap platform along a transverse direction of the cap platform.
Figure 5B:
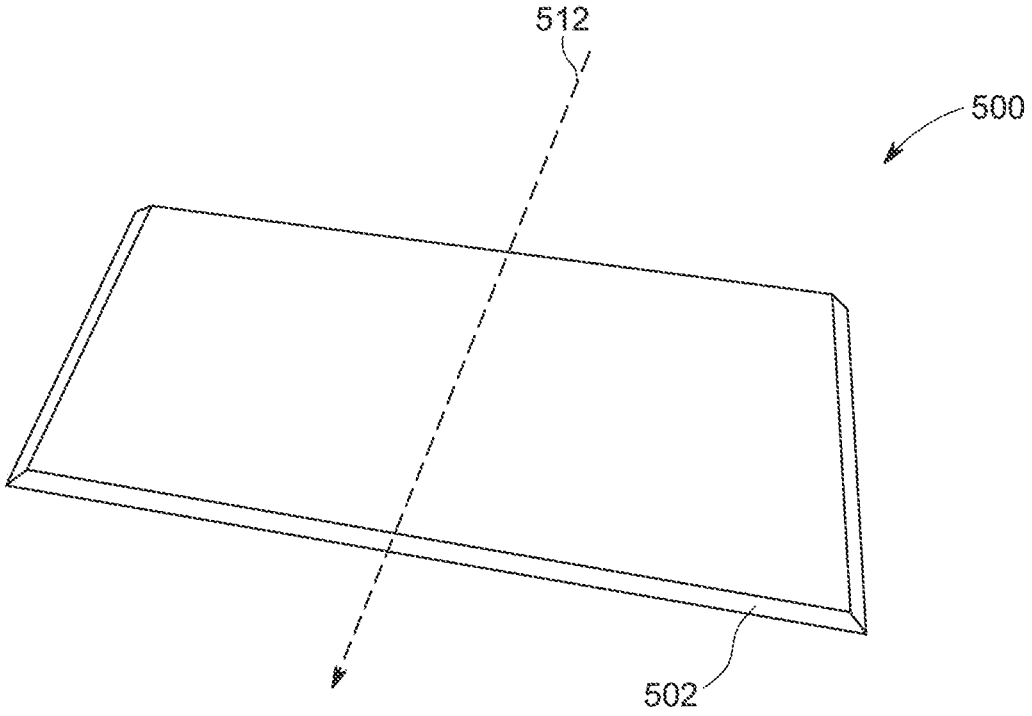
FIG. 5B shows a top perspective view of the cap of FIG. 5A. The cap platform is made from a composite material consisting of a thick layer of wood and a thin layer of metal which is glued to the top of the wood. The magnets in the cap platform operate to magnetically couple the cap with the top metallic layer of the drawer top, such as the drawer top of FIG. 4B.

FIG. 5A depicts a bottom perspective view of a cap 500 according to a preferred embodiment. According to this embodiment, the cap has two grooves 504 and 506 that are positioned symmetrically on each side of an axial axis 512 of the cap platform 502 and are cut in the bottom side of the cap platform 502. The grooves 504 and 506 are in sliding and/or removable engagement with a drawer top guide, such as the drawer top guides 332 and 334 shown in FIG. 3. Specifically, the cap 500 can slide in both direction along the axial direction of the cap platform 512. The cap 500 can also be freely removed from a drawer, such as the drawer 400, i.e., lifted from or placed on the drawer top 400. The cap 500 further includes two magnets 508 and 510 that are coupled with the cap platform 502 along a transverse direction of the cap platform 502. The magnets 508 and 510 in the cap platform 502 operate to magnetically couple the cap 500 with the top metallic layer of a drawer top, such as the drawer top 402 of the drawer 400 shown in FIG. 4B FIG. 5B depicts a top perspective view of the cap 500 of FIG. 5A. The cap platform 502 is made from a composite material consisting of a thick layer of wood and a thin layer of metal which is glued to the top of the wood. In an alternative embodiment, the top metallic layer of the cap platform 502 is fastened to the wood layer via at least one of screws, bolts, and nails.

Figure 6:
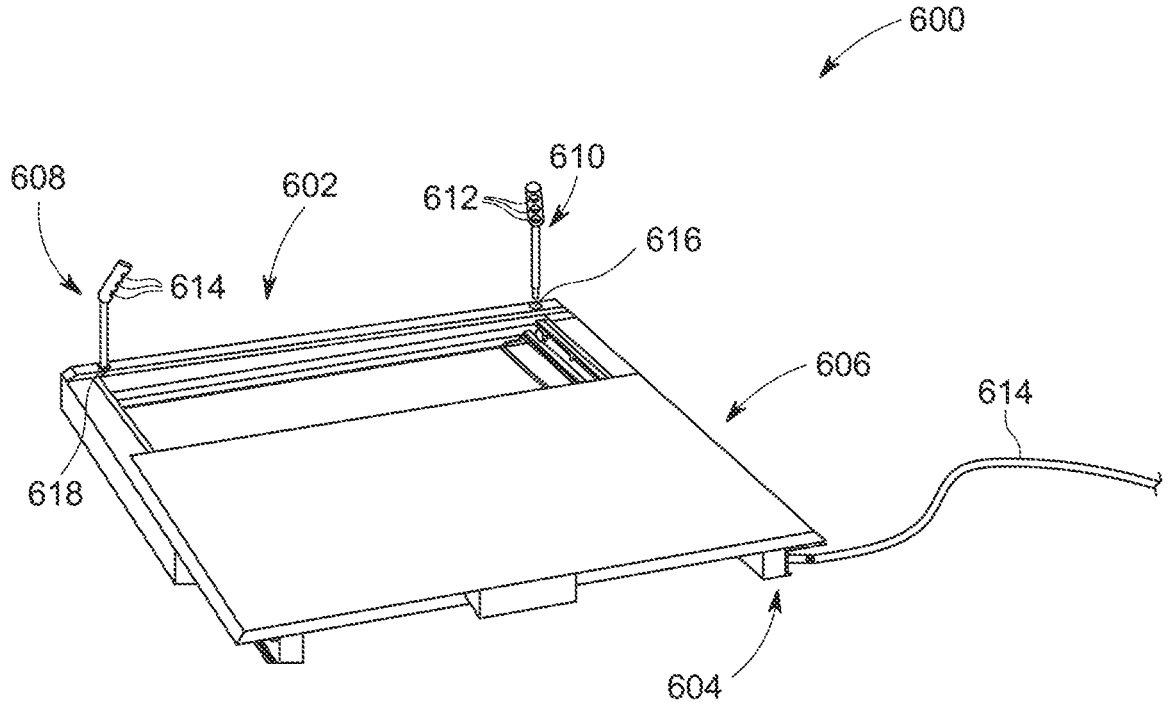
FIG. 6 shows a perspective view of a display according to a preferred embodiment. In this embodiment, the display further comprises two modular light fixtures, each having a plurality of light emitting diodes.

FIG. 6 depicts a perspective view of a display 600 according to a preferred embodiment. The display 600 comprises a riser 602, a drawer 604, and a cap 606. In this embodiment, the display 600 further comprises a lighting system comprising of two light fixtures 608 and 610. The light fixture 608 comprises a plurality of light emitting diodes (LEDs) 614 and the light fixture 610 comprises a plurality of LEDs 612. The light fixtures 608 and 610 are coupled with the riser 602 via two holes 616 and 618. In this preferred embodiment, the light fixtures 608 and 610 are modular such that upon insertion into the holes 616 and 618 they receive electrical power from the holes 616 and 618. Furthermore, the modular light fixtures 608 and 610 can easily be disconnected from the power source by pulling them out of the holes 616 and 618. The lighting system further includes a power source (not shown) provides the electrical power to the light fixtures 608 and 610. In a preferred embodiment, the power source is located remote and provides electrical power to the light fixtures 608 and 610 via a power line 614.

Figure 7:
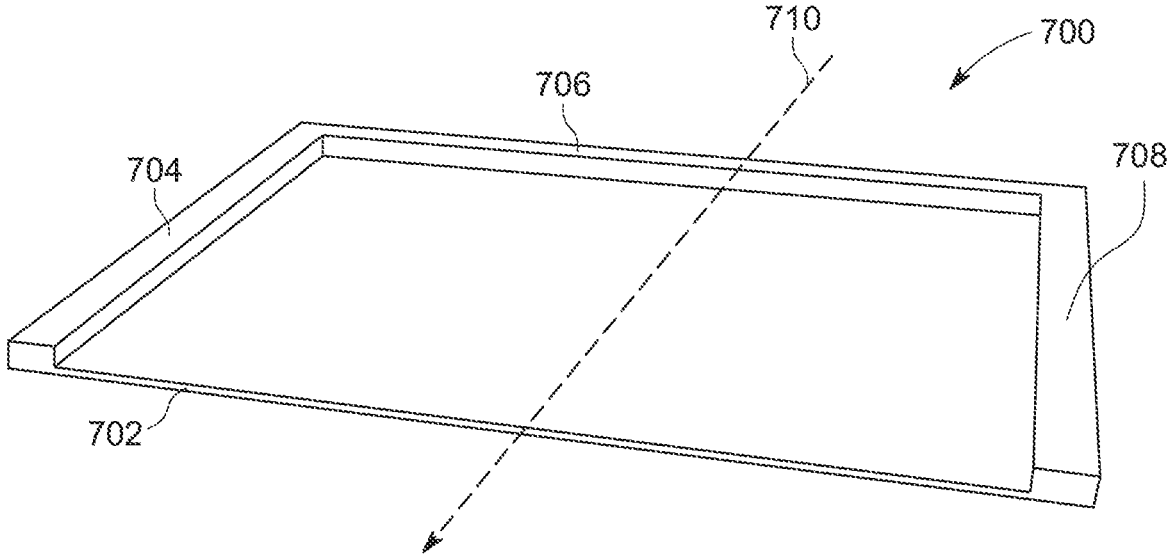
FIG. 7 shows a perspective view of a riser according to a preferred embodiment. In this embodiment, a display comprises of a riser and a cap without the use of a drawer. The riser has a riser side that is made up of three beams around a perimeter of the riser base. The cap, such as the one shown in FIGS. 8 and 9, is in sliding/and/or removable engagement with the riser side.

FIG. 7 depicts a perspective view of a riser 700 according to a preferred embodiment. In this embodiment, a display comprises of the riser 700 and a cap, such as the cap 800 shown in FIGS. 8A and 8B, without the need for a drawer.

The riser 700 is rectangular and has a riser base 702 having a substantially planar surface. The riser 700 further includes a riser side which extends upwardly from at least a portion of the perimeter of the riser base 702. The riser side is made up of three separate beams 704, 706, and 708. All three beams have a rectangular cross section, although other cross sections such as square, circular, triangular, elliptical, etc., are contemplated. In another embodiment, the riser side is a single piece structure and is coupled with the riser base 702 along three sides of the riser base 702. The fourth side of the riser base 702 is not coupled with any structure and is left open.

In this preferred embodiment, the riser side is coupled with the riser base 702 via one or more fasteners, such as bolts, screws, and/or nails. In another embodiment, the riser side may be coupled with the riser base 702 via an adhesive. The riser base 702 and its side can be made from a single material or a composite material. In this preferred embodiment, the riser base 702 and its side, i.e., the three separate beams 704, 706, and 708 are made from wood. Furthermore, in this preferred embodiment, the lengths of the three beams 704, 706, and 708 of the riser side cover the entire three sides of the rectangular riser base 702. In another embodiment, each of the three beams 704, 706, and 708 cover only a portion of the perimeter of the riser base 702, i.e., each of the three beams 704, 706, and 708 cover only a partial length of the corresponding side of the riser base 702.

In this embodiment, the riser 702 does not require any riser guides. The cap, such as the cap 800 shown in FIGS. 8A and 8B, comprises a cap side, extending downwardly from at least a portion of a perimeter of a cap platform, such as the cap platform 802 of the cap 800, wherein the cap side is in at least one of sliding and/or removable engagement with the riser side, i.e., the three beams 704, 706, and 708. Specifically, the cap 800 can slide in both direction along an axial direction of the cap platform 814, which in this embodiment is the same direction as the axial direction 710 of the riser base 702. The cap 800 can also be freely removed from the riser 702, i.e., lifted from or placed on the riser 702.

Figure 8A:
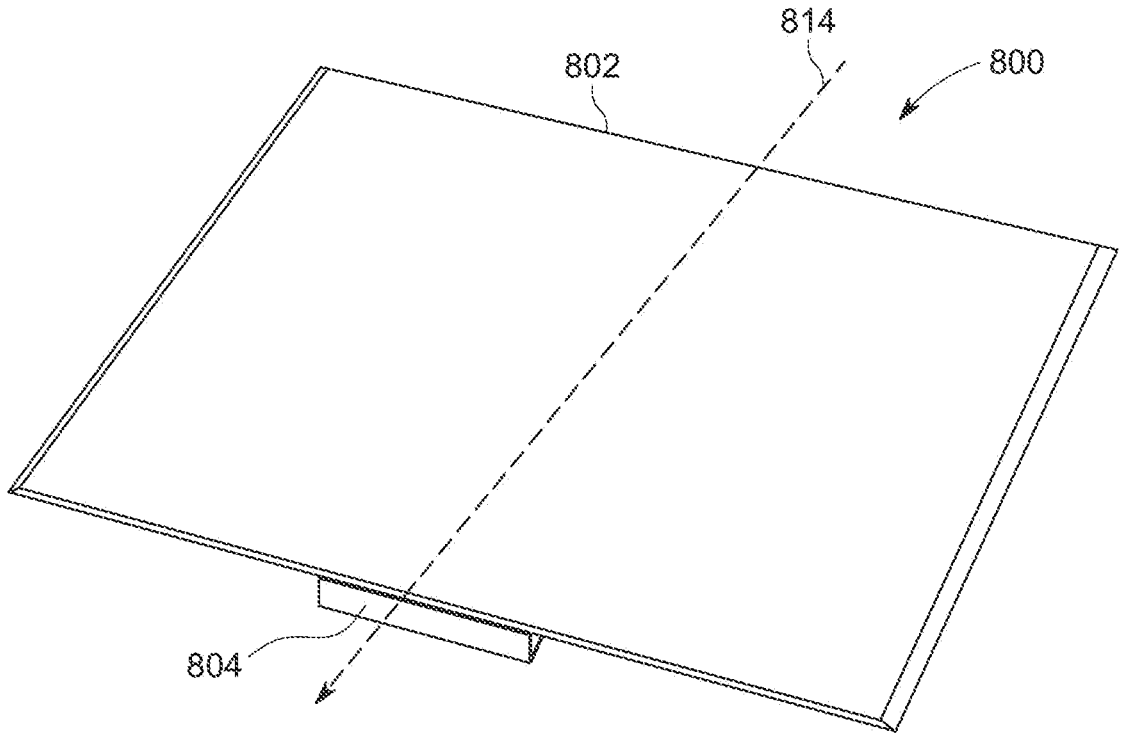
FIG. 8A shows a top perspective view of a cap according to a preferred embodiment. In this embodiment, a display comprises of a riser, such as the riser shown in FIG. 7, and this cap without the use of a drawer. The cap comprises a cap platform and a cap side which is in sliding and/or removable engagement with the riser side.

FIG. 8A depicts a top perspective view of a cap 800 according to a preferred embodiment. In this embodiment, a display comprises of a riser, such as the riser 700 shown in FIG. 7, and this cap 800 without the use of a drawer. The cap 800 comprises a cap platform 802 and a cap side, shown in FIG. 8B, which is in sliding and/or removable engagement with the riser side, such as the three beams 704, 706, and 708 of the riser side of the riser 700. The cap platform 802 is rectangular and has a substantially planar surface. The cap platform 802 can be made from a single material or a composite material. In this preferred embodiment, cap platform 802 is made from a composite material, namely a thick layer of wood on the bottom and a thin layer of sheet metal on the top. The sheet metal layer of the cap platform 802 can be used to magnetically secure items, such as jewelry holders that include magnets, to the cap platform 802. The cap 800 further includes a handle 804.

Figure 8B:
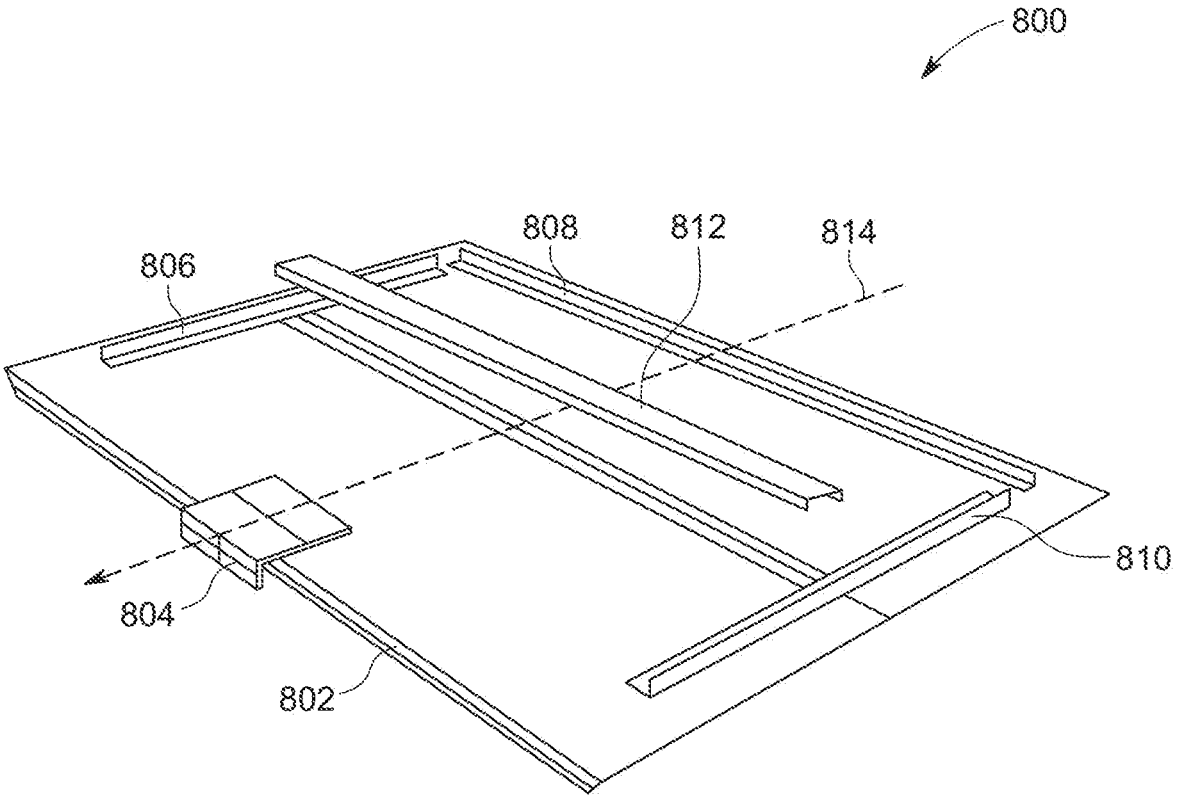
FIG. 8B shows a bottom perspective view of the cap of FIG. 8A. The cap includes a cap side which comprises of three L-shaped beams, wherein two of them are coupled with the cap platform along an axial direction of the cap platform and the third. L-shaped beam is coupled with the cap platform along a transverse direction of the cap platform. The cap further includes a support beam along a transverse direction of the cap platform. The support beam resists bending of the cap platform around its axial direction

FIG. 8B shows a bottom perspective view of the cap 800 of FIG. 8A. The cap includes a cap side which comprises of three L-shaped beams (L beams, known to artisans of ordinary skill), wherein two of them, 806 and 810 are coupled with the cap platform 802 along the axial direction 814 of the cap platform 802, and the third L-shaped beam 808 is coupled with the cap platform 802 along a transverse direction of the cap platform 802. The third L-shaped beam 808 operates to prevent the cap 800 from sliding too far when it makes contact with the beam 706. The cap 800 further includes a support beam 812, similar to the support beam 416 of the drawer 400 (see FIG. 4A) along the transverse direction of the cap platform 802. The support beam 812 resists bending of the cap platform 802 around the axial direction 814.

The foregoing explanations, descriptions, illustrations, examples, and discussions have been set forth to assist the reader with understanding this invention and further to demonstrate the utility and novelty of it and are by no means restrictive of the scope of the invention. It is the following claims, including all equivalents, which are intended to define the scope of this invention.

What is claimed is:

1. A display, comprising:
(a) a riser, comprising:
(i) a riser base having a substantially planar surface;
(ii) a riser side extending upwardly from at least a portion of a perimeter of the riser base; and
(iii) a riser guide coupled with at least one of the riser base and the riser side;
(b) a drawer, comprising:
(i) a drawer top having a substantially planar surface;
(ii) a drawer side extending downwardly from at least a portion of a perimeter of the drawer top;
(iii) a drawer side guide coupled with the drawer side, wherein the drawer side guide is in sliding engagement with the riser guide; and
(iv) a drawer top guide coupled with the drawer top; and
(c) a cap, comprising:
(i) a cap platform having a substantially planar surface; and
(ii) at least one of a groove in the cap platform and a cap platform guide coupled with the cap platform, wherein the at least one of a groove in the cap platform and a cap platform guide coupled with the cap platform is in at least one of sliding and removable engagement with the drawer top guide.

2. The display of claim 1, wherein the riser base is rectangular.

3. The display of claim 2, wherein the riser side comprises three beams having rectangular cross sections.

4. The display of claim 3, wherein the riser guide comprises two guide rails coupled with two of the three beams along an axial direction of the riser base.

5. The display of claim 3, wherein the riser guide comprises two guide rails coupled with the riser base along an axial direction of the riser base.

6. The display of claim 3, wherein a height of the three beams is greater than zero, thereby, the display providing a storage space between the drawer and the riser.

7. The display of claim 1, wherein the drawer top is rectangular.

8. The display of claim 7, wherein the drawer side comprises two beams having rectangular cross sections.

9. The display of claim 8, wherein the drawer side guide comprises two guide rails coupled with the two beams along an axial direction of the drawer top.

10. The display of claim 7, wherein the drawer top guide comprises two strips coupled with the drawer top along an axial direction of the drawer top.

11. The display of claim 7, wherein the drawer further comprises a support beam coupled with the drawer top along a transverse direction of the drawer top.

12. The display of claim 7, wherein the drawer further comprises a handle coupled with the drawer top.

13. The display of claim 1, wherein the cap platform is rectangular.

14. The display of claim 13, wherein the cap platform comprises two grooves along an axial direction of the cap platform.

15. The display of claim 13, wherein the cap further comprises one or more magnet coupled with the cap platform along a transverse direction of the cap platform.

16. The display of claim 1, wherein the riser base, the riser side, the drawer top, the drawer side, and the cap platform are made from wood.

17. The display of claim 1, wherein the drawer top comprises a composite material made from wood and metal.

18. The display of claim 1, wherein the cap platform comprises a composite material made from wood and metal.

19. A method of displaying an article via a display, the display comprising:
(a) a riser, comprising:
(i) a riser base having a substantially planar surface;
(ii) a riser side extending upwardly from at least a portion of a perimeter of the riser base; and
(iii) a riser guide coupled with at least, one of the riser base and the riser side;
(b) a drawer, comprising:
(i) a drawer top having a substantially planar surface;
(ii) a drawer side extending downwardly from at least a portion of a perimeter of the drawer top;
(iii) a drawer side guide coupled with the drawer side, wherein the drawer side guide is in sliding engagement with the riser guide; and
(iv) a drawer top guide coupled with the drawer top; and
(c) a cap, comprising:
(i) a cap platform having a substantially planar surface; and
(ii) at least one of a groove in the cap platform and a cap platform guide coupled with the cap platform, wherein the at least one of a groove in the cap platform and a cap platform guide coupled with the cap platform is in at least one of sliding and removable engagement with the drawer top guide;

the method comprising at least one of:

(1) placing the cap on the drawer; and (2) sliding the drawer; and (3) removing the cap from the drawer.

* * * * *